United States Patent [19]

Majernik et al.

[11] Patent Number: 5,046,967

[45] Date of Patent: Sep. 10, 1991

[54] ELECTRICAL CONNECTOR SHELL INCLUDING PLASTIC AND METAL PORTIONS, AND METHOD OF ASSEMBLY

[75] Inventors: Joseph Majernik, Endicott, N.Y.; Lonnie Fisher, Hallstead, Pa.

[73] Assignee: Amphenol Interconnect Products Corporation, Endicott, N.Y.

[21] Appl. No.: 488,943

[22] Filed: Mar. 5, 1990

[51] Int. Cl.[5] ..... H01R 9/03

[52] U.S. Cl. ..... 439/610; 439/931; 439/736

[58] Field of Search ..... 439/607-610, 439/88, 86, 931, 904, 905, 736, 934, 931

[56] References Cited

U.S. PATENT DOCUMENTS

| | | | |
|---|---|---|---|
| 3,744,128 | 7/1973 | Fisher et al. | 439/88 |
| 3,958,851 | 5/1976 | Evans | 439/931 |
| 3,960,433 | 6/1976 | Boliver | 439/934 |
| 4,497,533 | 2/1985 | Genova et al. | 439/88 |
| 4,582,384 | 4/1986 | Frantz et al. | 439/610 |
| 4,597,624 | 7/1986 | Lax et al. | 339/143 R |
| 4,597,836 | 7/1986 | Schaer et al. | 204/4 |
| 4,640,570 | 2/1987 | Strate | 339/182 R |
| 4,772,212 | 9/1988 | Sotolongo | 439/98 |
| 4,776,803 | 10/1988 | Pretchel et al. | 439/59 |
| 4,786,260 | 11/1988 | Spalding | 439/610 |
| 4,830,629 | 5/1989 | Yoshimura | 439/610 |

FOREIGN PATENT DOCUMENTS 0002890 7/1979 European Pat. Off. .

*Primary Examiner*—David L. Pirlot
*Attorney, Agent, or Firm*—Bacon & Thomas

[57] ABSTRACT

A method for joining metal and plastic parts, in particular in electrical connector shells, includes the steps of insert-molding a first metal part into a plastic part and subsequently joining the first metal part to a second metal part at a metal-to-metal interface by conventional metal joining techniques. In an electrical connector made by the above method, a composite metal and plastic backshell includes a metal portion insert-molded into a plastic portion. A metal frontshell can then be connected to the backshell by attaching it to the metal backshell portion using simple metal joining techniques such as crimping or riveting.

14 Claims, 2 Drawing Sheets

ELECTRICAL CONNECTOR SHELL INCLUDING PLASTIC AND METAL PORTIONS, AND METHOD OF ASSEMBLY

BACKGROUND OF THE INVENTION

1. Field of the Invention

This invention relates to a method of joining metal and plastic parts, for example in an electrical connector, and to an electrical connector which is assembled using such a method.

2. Description of Related Art

Electrical connectors are known in which a portion of the housing is formed from plastic. Plastic is used because it is relatively easy to mold, light, and inexpensive in comparison with metal. The plastic may be plated with a metal for the purpose of ensuring shield continuity in order to prevent undesired RF transmission through the connector shell.

In such connectors, a problem arises when it is necessary to connect the plastic to metal portions of the shell. Metal may be provided even in a generally plastic housing, for example, to hold connector inserts in place, to provide shielding as noted above, or to provide electrical ground paths to another connector or other electrical device.

A conventional method of joining metal to plastic in connector shells has been to directly solder the plastic portion to the metal portion in a continuous bead. This method is both difficult and expensive. A need, therefore, has arisen for a simpler and less expensive method of attaching a plastic connector shell portion to a metal connector shell portion of a connector.

SUMMARY OF THE INVENTION

The invention provides a method of joining metal to plastic parts for use in a variety of containers or housings, and in particular for use in electrical connector shells. The method includes the steps of first insert-molding a metal joining part into a plastic part, and subsequently joining the metal joining part to a second metal part by conventional metal joining techniques, thereby joining the second metal part to the plastic part via the metal joining part.

In the specific case of an electrical connector shell, the method includes the steps of insert-molding a first metal shell portion into a plastic molded shell portion in order to provide a composite plastic backshell, and using conventional metal-to-metal joining techniques to attach the insert-molded metal backshell portion to a metal frontshell portion in order to complete the connector shell.

The method may advantageously include the step of metal plating the plastic backshell portion after the step of insert molding.

A connector shell made according to the above method includes a metal frontshell, a molded plastic backshell portion, and a metal backshell portion insert-molded into the molded plastic backshell portion and joined to the metal frontshell by metal-to-metal joining techniques. The plastic backshell portion may be plated for EMI shielding effectiveness and/or grounding.

DESCRIPTION OF THE PREFERRED EMBODIMENTS

Figure 1:
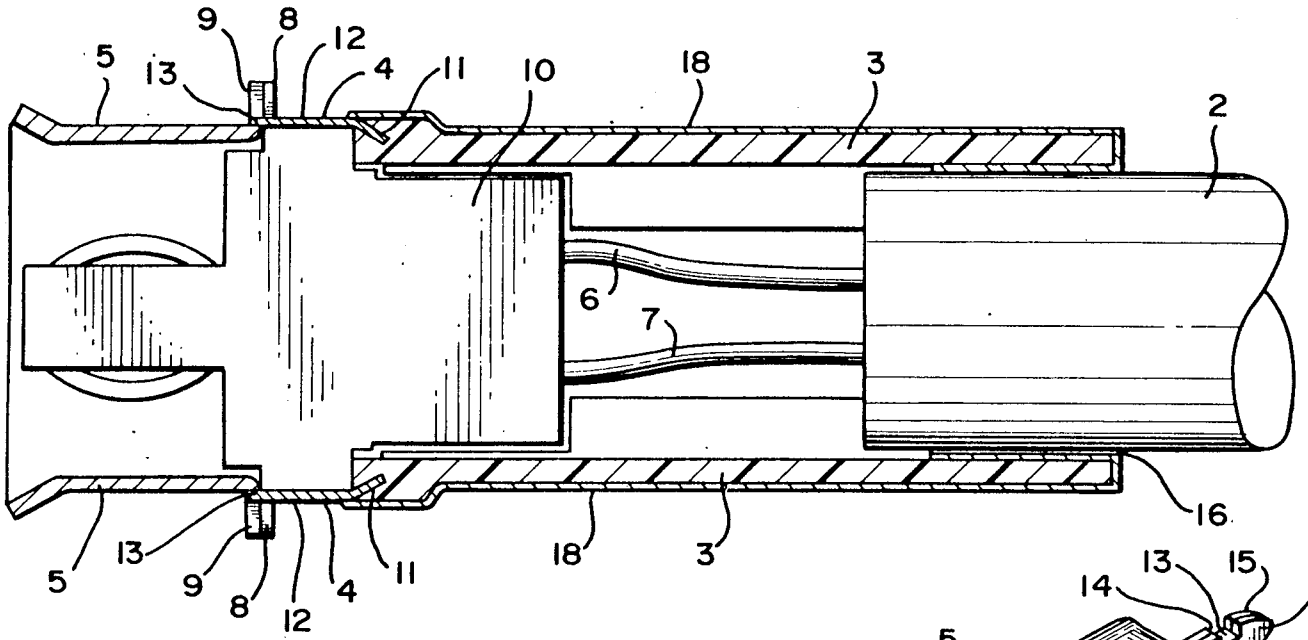
FIG. 1 is a cross-sectional view of an electrical connector assembled according to the principles of the preferred embodiment.

FIG. 1 is a cross-sectional view of an assembled connector according to a preferred embodiment of the invention. The connector assembly is used to provide an interface between a cable 2 and an electrical device such as a computer. The cable 2 is conventional and may include, for example, any known multi-wire cable, including ribbon cables, and coaxial cables.

Figure 3B:
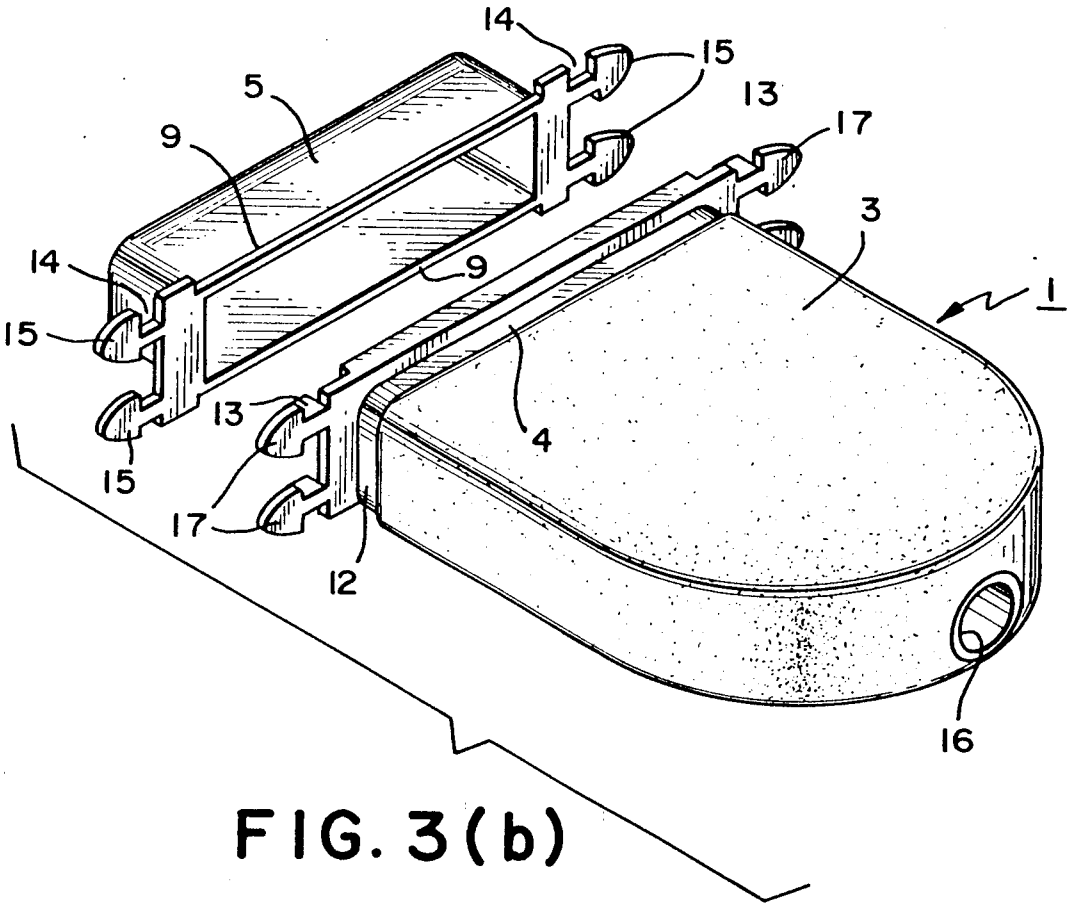
FIG. 3*b* is a perspective view of a metal backshell portion for use in the electrical connector shell of FIG. 1.

An opening 16, best shown in FIG. 3*b*, is provided at the rear of a connector composite back shell 1 to provide an entrance for the cable 2 into the connector. The opening 16 is suitably shaped according to the shape of the cable for which the connector is intended, and may include appropriate seals or gaskets for isolating the interior of the connector and also strain relief means for preventing tension on the cable from being transmitted to wires and connections in the interior of the connector.

Figure 3A:
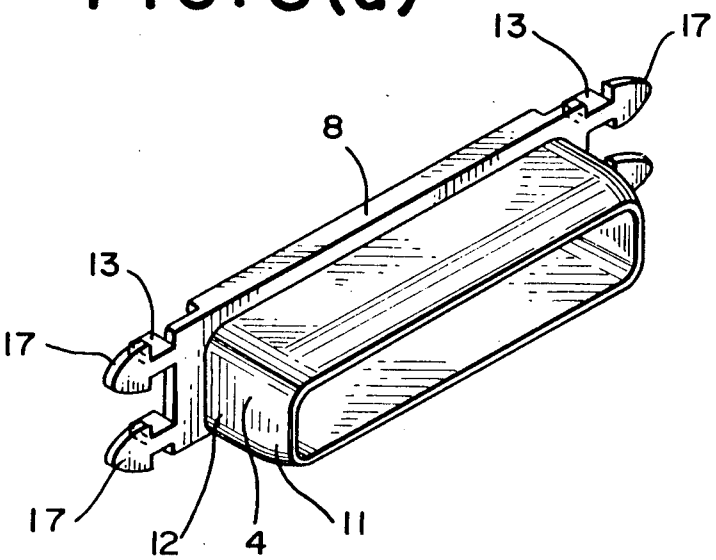
FIG. 3*a* is a perspective view of the unassembled electrical connector shell of FIG. 1.

Connector composite backshell 1 includes plastic backshell portion 3 and a metal backshell portion 4. Also included is a metal frontshell 5. The metal backshell portion, best shown in FIG. 3(*a*), is insert-molded into the plastic backshell portion to form backshell 1, depicted in FIG. 3(*b*) together with frontshell 5.

Frontshell 5 includes an opening for passage of electrical contacts and is adapted to mate with a suitably shaped connector, for example in an electrical device (not shown). It is intended that the frontshell not be limited to a particular shape, as the shape will depend on the configuration of the device to which the connector is to be mated. The illustrated connector is of the type used, for example to connect peripheral devices such as printers to communications ports in a computer system, but the invention is applicable to any system using cable connectors.

Metal backshell portion 4 includes a flange 8 having laterally extending tab portions 17 which, together with tab portions 15 on flange 9 of frontshell 5, form retaining means to which a retaining wire or the like can be attached to secure the connector to an electrical device in a known manner. Numerous other means for securing the connector to an electrical device will likewise occur to those skilled in the art.

Backshell portion 4 also includes forwardly projecting tabs 13 which engage recesses 14 in flange 9 of frontshell 5 to align the frontshell 5 and backshell 1 together upon final assembly. Again, numerous other alignment means will occur to those skilled in the art and the invention is not intended to be limited to a particular flange or tab structure.

Figure 2:
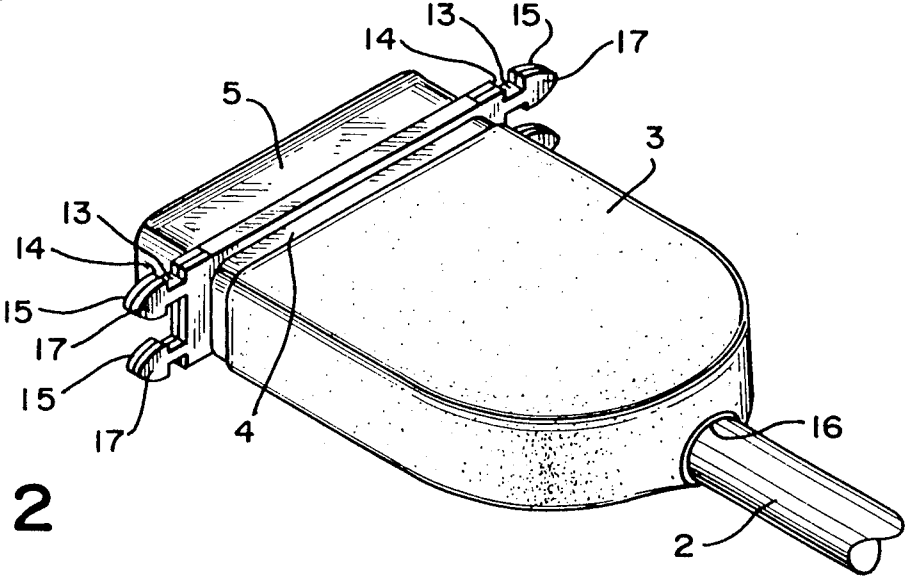
FIG. 2 is a perspective view of the assembled electrical connector shell of FIG. 1.

As will be described in more detail below, prior to assembly of the connector, metal backshell portion 4 is insert-molded into plastic backshell portion 3 to form the composite backshell 1 such that a surface 12 of the metal backshell, including flange 8, remains exposed as shown in FIGS. 1, 2 and 3*b*. After insert-molding, plastic backshell 3 may then, optionally, be plated with a metal coating 18 for the purpose of shielding the interior of the connector from electromagnetic interference.

It has been found that a coating of a 300-500 micro inch layer of electrolytic copper and a further 300-500 micro inch layer of electrolytic nickel provides a satisfactory EMI shield with good adhesion to the plastic of the backshell. However, it will be recognized by those skilled in the art that other conductive metal platings or coatings may be used to form a shield on the plastic member, and therefore that the invention should not be limited to a particular coating. Metal backshell 4 is itself formed from steel using conventional methods, although other metals such as copper or brass may also be used depending on the desired use for the connector.

As shown in FIG. 1, cable 2 is electrically connected to a conventional terminal block 10 which is retained by metal backshell portion 4. Terminal block 10 forms no part of the present invention except insofar as the backshell 4 must be suitably shaped to hold the terminal block in place.

Commonly, such a terminal block includes electrical pins to which individual wires in the cable are connected, and electrical contacts designed to mate with corresponding contacts in an electrical device terminal, as is well known in the art. The terminal block may also include electrical contacts which contact the connector shell to provide a ground path for the cable shield or ground wires, and may also include a variety of electrical filters, or other terminator circuits. Examples of prior art terminal blocks are shown in U.S. Pat. Nos. 3,999,830, 4,820,175, and 4,674,807, incorporated herein by reference.

Terminal block 10 is held in the connector composite backshell 1 by metal backshell 4. In connectors in which the terminal block is grounded to the shell, a grounding spring or conductive gasket arrangement (not shown) may be included to provide a secure electrical path between the terminal block and the housing shell and to further hold the terminal block in the housing, or to provide shock absorption to protect components of the terminal block.

In order to assemble the above-described connector, composite backshell 1 is first manufactured by insert-molding metal backshell portion 4 into plastic backshell portion 3. Insert molding techniques are well known in the art and essential comprising molding the plastic portion in a mold such that the molten plastic surrounds the metal to be insert-molded. At this time, plating may be added if desired. The insert-molded metal backshell portion 4 then becomes a joining part which permits attachment of the primarily plastic composite backshell 1 to frontshell 5 by metal joining techniques well known by those skilled in the art.

The composite backshell 1 and frontshell 5 may be packaged and sold as a kit, or immediately prepared for assembly to a desired cable as follows:

A cable is first inserted through opening 16 provided in the backshell and the terminal block is connected to the cable at the front side of the backshell, for example, by soldering individual wires in the cable to selected pins or contacts on the terminal block. The terminal block may then be inserted from the front side of the metal backshell so that it fits within the metal backshell as shown in FIG. 2.

As a final step, the metal frontshell is connected to the metal backshell by metal joining methods such as belting, crimping, riveting or welding. There is no need to use complex plastic to metal joining techniques during assembly to the cable because the metal backshell has been prejoined to the plastic backshell during the previous step of insert molding.

Those skilled in the art will note that the assembly procedure which follows the step of forming the composite metal and plastic backshell is the same as would be used if the shell were made entirely of metal. Thus, the invention provides the ease-of-assembly advantages of a metal shell while nevertheless obtaining a composite shell with its attendant lower materials cost, lighter weight, attractiveness, and other advantages.

In addition, those skilled in the art will appreciate that numerous modifications of the invention are possible. For example, the technique of providing insert-molded metal to plastic hybric parts prior to assembly could be used to join parts of the connectors other than housing back and front shells to each other. The connector shell itself could be divided into top and bottom halves, or into a plurality of plastic and metal parts.

In addition, the method described above may have application to fields other than the field of connectors. It is contemplated that the inventive concept of joining of metal to plastic by insert molding prior to assembly could be used in a variety of containers and other products. Consequently, it is desired that the appended claims be construed to include all possible alternative embodiments and modifications of the invention except insofar as they are limited by the prior art.

We claim:

1. An electrical connector shell, comprising:

a plastic shell portion; a first metal shell portion; and a second metal shell portion, wherein a plastic-to-metal interface portion of said first metal shell portion is insert-molded into a plastic-to-metal interface portion of said plastic shell portion to form a composite metal and plastic interface portion, a second portion of said first metal shell portion being free of plastic, wherein said first and second metal shell portions are joined together at a metal-to-metal interface and wherein said electrical connector shell further comprises shielding means for electrically shielding said plastic shell portion, said shielding means including a metal coating on said plastic shell portion.

2. An electrical connector shell as claimed in claim 1, further comprising joining means on said first and second metal shell portions for facilitating joining at said metal-to-metal interface.

3. An electrical connector as claimed in claim 2, wherein said joining means includes a flange on each of said first and second metal shell portions.

4. An electrical connector shell as claimed in claim 2, wherein said joining means includes retaining means for securing said connector shell to an electrical device.

5. An electrical connector shell as claimed in claim 1, wherein said metal coating includes a coating of electroless copper beneath a layer of electrolytic copper and a further layer of electrolytic nickel.

6. An electrical connector shell as claimed in claim 1, wherein said second metal shell portion is a connector frontshell and said first metal shell portion and said plastic shell portion together form a connector backshell.

7. An electrical connector comprising a plastic shell portion; a first metal shell portion; and a second metal shell portion, wherein a plastic-to-metal interface portion of said first metal shell portion is insert-molded into a plastic-to-metal interface portion of said plastic shell portion to form a composite metal and plastic shell portion, a second portion of said first metal shell portion being free of plastic and a second portion of said plastic portion being free of metal, and wherein said first and second metal shell portions are joined together at a metal-to-metal interface, and further comprising a terminal block within said second portion of said first metal shell portion including means for providing an electrical path between a cable and an electrical device, and shielding means for electrically shielding said plastic shell portion, said shielding means including a metal coating on said plastic portion.

8. An electrical connector as claimed in claim 7, further comprising grounding means for providing an electrical ground path between said terminal block and said second portion of said first metal shell portion.

9. A container comprising:

a plastic portion having exterior and interior surfaces; shielding means for electrically shielding said plastic portion, said shielding means including a metal coating which covers the exterior surfaces of said plastic portion; a first metal portion; and a second metal portion, wherein said metal coating, first metal portion, and second metal portion together form a continuous electrical shield when said second metal portion is joined to said first metal portion, respective metal-to-plastic interface portions of said first metal portion and said plastic portion being insert-molded together to form a composite metal and plastic portion arranged to enable the first and second metal portions to be joined together at a metal interface to complete said container and form said continuous shield, and wherein interior surfaces of said first metal portion are free of plastic and the interior surfaces of said plastic portion are free of metal.

10. A method as claimed in claim 9, wherein said first metal portion and said plastic portion together form an electrical connector backshell, and said second metal portion is an electrical connector frontshell.

11. A method of joining plastic to metal, comprising the steps of insert-molding a plastic-to-metal interface portion of a first metal part into a plastic-to-metal interface portion of a plastic part having interior and exterior surfaces such that a second portion of said first metal part remains free of plastic and a second portion of said plastic part remains free of metal; subsequently metal plating the exterior surfaces of said plastic portion to form an electrical shield for said plastic part, said step of metal plating including the step of causing a resulting metal coating on the exterior surfaces of said plastic portion to contact said first metal part to provide electrical shielding continuity between said metal coating and said first metal part; and joining said first metal part to a second metal part at a metal-to-metal interface.

12. A method as claimed in claim 11, wherein said step of joining comprises a step selected from the group consisting of riveting, crimping, bolting, screwing, and welding.

13. A method as claimed in claim 9, wherein said container is an electrical shell.

14. A method as claimed in claim 13, further comprising the steps of providing a cable and a terminal block, inserting said cable into said plastic part, electrically connecting said cable to said terminal block, and subsequently joining said metal parts together.

* * * * *